US008540652B2

(12) United States Patent
Tong et al.

(10) Patent No.: US 8,540,652 B2
(45) Date of Patent: Sep. 24, 2013

(54) ROBOTIC TRAINING SYSTEM WITH MULTI-ORIENTATION MODULE

(75) Inventors: Kai Yu Tong, Kowloon (HK); Rong Song, Kowloon (HK); Chiu Hoi Lam, Kowloon (HK); Wai Man Tam, Kowloon (HK); Shu To Ng, Kowloon (HK); Tak Chi Lee, Kowloon (HK); Man Kit Peter Pang, Kowloon (HK); King Lun Kwok, Kowloon (HK); Yin Bonn Philip Tsui, Kowloon (HK); Woon Fong Wallace Leung, Kowloon (HK)

(73) Assignee: The Hong Kong Polytechnic University, Hung Hom, Kowloon (HK)

( * ) Notice: Subject to any disclaimer, the term of this patent is extended or adjusted under 35 U.S.C. 154(b) by 1234 days.

(21) Appl. No.: 11/802,267

(22) Filed: May 22, 2007

(65) Prior Publication Data

US 2008/0294074 A1 Nov. 27, 2008

(51) Int. Cl.
*A61H 1/02* (2006.01)

(52) U.S. Cl.
USPC ..... 601/5; 601/23; 601/33; 600/546

(58) Field of Classification Search
USPC ..... 601/5, 23–26, 33–36, 84; 600/546, 600/587
See application file for complete search history.

(56) References Cited

U.S. PATENT DOCUMENTS

| | | | | |
|---|---|---|---|---|
| 4,030,141 | A | 6/1977 | Graupe | |
| 4,691,694 | A * | 9/1987 | Boyd et al. | 601/34 |
| 4,934,694 | A * | 6/1990 | McIntosh | 482/9 |
| 4,936,299 | A | 6/1990 | Erlandson | |
| 5,209,223 | A * | 5/1993 | McGorry et al. | 601/34 |
| 5,417,643 | A * | 5/1995 | Taylor | 601/33 |
| 5,454,773 | A * | 10/1995 | Blanchard et al. | 482/133 |
| 5,466,213 | A | 11/1995 | Hogan et al. | |
| 5,645,073 | A | 7/1997 | Kadefors et al. | |
| 5,679,004 | A | 10/1997 | McGowan et al. | |
| 5,720,711 | A * | 2/1998 | Bond et al. | 601/23 |
| 5,722,937 | A * | 3/1998 | Smith | 601/23 |
| 5,755,645 | A | 5/1998 | Miller et al. | |
| 5,830,160 | A | 11/1998 | Reinkensmeyer | |
| 6,379,393 | B1 | 4/2002 | Mavroidis et al. | |
| 6,500,094 | B1 | 12/2002 | Lin | |
| 6,613,000 | B1 | 9/2003 | Reinkensmeyer et al. | |
| 6,859,663 | B2 | 2/2005 | Kajitani et al. | |
| 6,878,122 | B2 | 4/2005 | Cordo | |
| 6,966,882 | B2 | 11/2005 | Horst | |
| 2005/0209055 | A1 * | 9/2005 | Anders | 482/51 |
| 2006/0106326 | A1 | 5/2006 | Krebs et al. | |
| 2007/0060849 | A1 * | 3/2007 | Bluman | 601/33 |
| 2007/0185418 | A1 * | 8/2007 | Mitsuishi et al. | 601/34 |
| 2007/0191743 | A1 * | 8/2007 | McBean et al. | 601/5 |
| 2008/0161733 | A1 * | 7/2008 | Einav et al. | 601/34 |
| 2009/0149783 | A1 * | 6/2009 | Nef et al. | 601/5 |
| 2009/0259338 | A1 * | 10/2009 | Tong et al. | 600/546 |

* cited by examiner

*Primary Examiner* — Quang D Thanh

(74) *Attorney, Agent, or Firm* — The Hong Kong Polytechnic University

(57) ABSTRACT

The present invention relates a system and method to allow users to train different joints of a limb in different planes. The rotation of the system can be driven by a motor to assist or resist the motion for training purpose. By the present invention, the user can use the device to switch training between the vertical and horizontal planes, without changing the device and any module. The system is also adjustable to meet different users' body sizes.

20 Claims, 8 Drawing Sheets

ROBOTIC TRAINING SYSTEM WITH MULTI-ORIENTATION MODULE

BACKGROUND

Stroke is a leading cause of permanent disability in adults, with clinical symptoms such as, weakness, spasticity, contracture, loss of dexterity, and pain at the paretic side. Approximately 70% to 80% of people who sustain a stroke have upper-extremity impairment and require continuous long-term medical care to reduce their physical impairment. The traditional view on poststroke rehabilitation is that significant improvements in motor recovery only occur within the first year after stroke, associated greatly with the spontaneous recovery of the injured brain. However, recent studies suggest that intensive therapeutic interventions, such as constraint-induced movement therapy and task-relevant repetitive practice of the affected limb, can also contribute to significantly reduced motor impairment and improved functional use of the affected arm in persons with chronic stroke.

In the absence of direct repair on the damaged brain tissues after stroke, neuro-rehabilitation is an arduous process, because poststroke rehabilitation programs are usually time-consuming and labor-intensive for both the therapist and the patient in one-to-one manual interaction. Recent technologies have made it possible to use robotic devices as assistance by the therapist, providing safe and intensive rehabilitation with repeated motions to persons after stroke. Commonly reported motion types provided by developed rehabilitation robots are: (1) continuous passive motion, (2) active-assisted movement, and (3) active-resisted movement. During treatment with continuous passive motion, the movements of the patient's limb(s) on the paretic side are guided by the robot system as the patient stays in a relaxed condition. This type of intervention was found to be effective in temporarily reducing hypertonia in chronic stroke, and in maintaining joint flexibility and stability for persons after stroke in the early stage. In active-assisted robotic treatment (or interactive robotic treatment), the rehabilitation robot would provide external assisting forces when the patient could not complete a desired movement independently. Robotic treatment with active-resisted motion involved voluntarily completing movements against programmed resistance.

Despite positive documentation of overall clinical outcomes following robot-assisted rehabilitation of chronic stroke, and easily modifiable system capable of training multiple bodily limbs in multiple planes have not been developed. The majority systems require multiple modules that must be switched out to accommodate different modes of training.

It is an object of the present invention to provide a robotic training system and modules for multiple limb training and overcome the disadvantages and problems in the prior art.

DESCRIPTION

The present invention proposes a robotic training system having a rotational unit and utilizing multi-orientational modules, such rotational units and modules allowing the system to train different limbs, and different joints within a limb in different planes (x, y, or z).

The rotational unit of the robotic system is capable of being operational within an orientation range of 90°, i.e. from totally horizontal to totally vertical. The module is mounted on the rotational unit and can accommodate a limb at various angles to allowing training in different planes, as well as training different joints of the limb.

The use of the rotational unit and module in the present invention assists in training multiple joints using one module as opposed to "switching out" or changing modules. The requirement of "switching out" modules requires additional time and effort.

These and other features, aspects, and advantages of the apparatus and methods of the present invention will become better understood from the following description, appended claims, and accompanying drawings where:

FIG. 1 exhibits an embodiment of the robotic system of the present invention;

Figure 10:
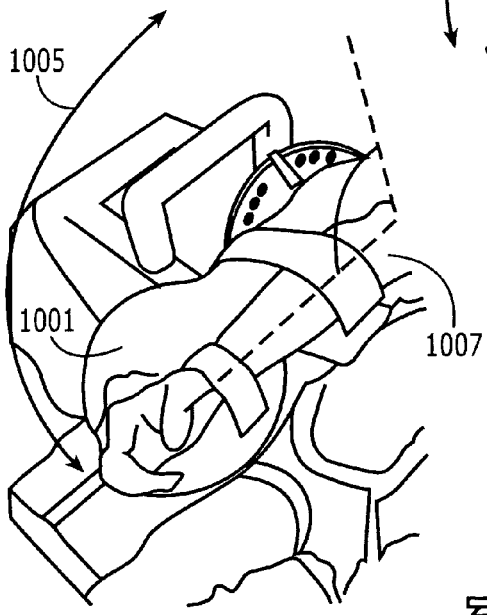
Figure 11:
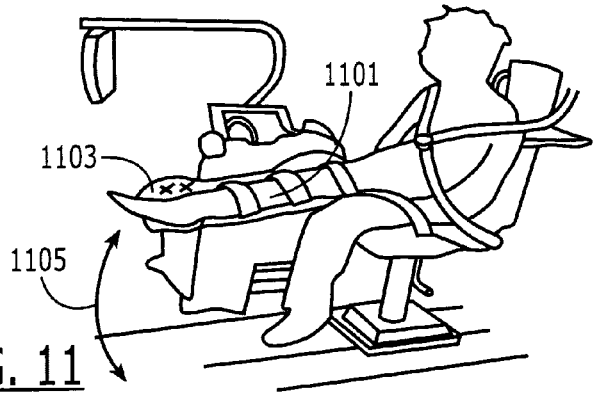

FIG. 10 shown the plane of movement of the arm when the module is horizontally positioned;

FIG. 11 shows the attachment of a lower extremity (leg) to a module; and

FIG. 12-16, with reference to the Example, graphs the results on users trained with the robotic system as taught herein.

The following description of certain exemplary embodiment(s) is merely exemplary in nature and is in no way intended to limit the invention, its application, or uses. Throughout this description, the term "training" refers to methods applied by or to a user to teach or re-learn skills, including physical skills, and mental skills.

The term "limb" refers to an arm or leg with all its components. The term "joint" refers to a place of union between two or more bones. Them term "electronically operable" shall refer to systems generally employing microprocessors, resistors, capacitors, inductors, and sensors for extracting information from mechanical inputs and outputs via electrical actuators to mechanical systems Now, to FIGS. 1-16, which while presented individually, are to be considered in total when evaluating the present invention.

The present invention relates to a robotic system for training different joints in different planes. Multi-orientation modules are utilized with the robotic system to allow particular training, whereby one module can be used for training as opposed to "switching out" one module for another. The following figures present the robotic system and the modules to be used therewith, as well as providing information on the type of bodily movements to be trained using the robotic system.

Figure 1:
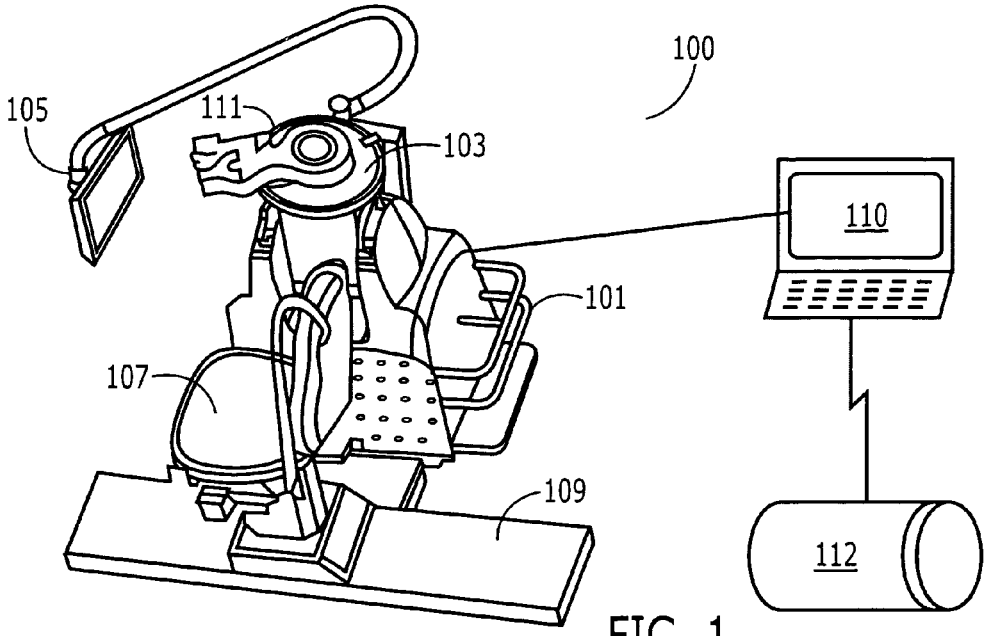

FIG. 1 is an embodiment of the robotic system 100 for training joints and muscle associated therewith in accordance with the present invention. The system 100 generally includes a control tower 101, a rotational motor tower 103, a patient positioning unit 107, a multi-orientation module 111, and a feedback monitor 105.

The control tower 101 has as a purpose providing a stand for the multi-orientation module 111. Further, the control tower 101 may be used as housing for electronics and mechanical components used to operate the system 100.

Examples of electronic components housed in the control tower 101 include breadboards, resistors, capacitors, wire connectors, Integrated Circuits, and the like. Power converting equipment, such as AC to DC converters can be stored therein. Further, the control tower 101 can house computing components, such as permanent or short-term memory, microprocessors, connections for user interface devices, wireless communication equipment such as antennas, WIFI, Bluetooth™, and the like. Other necessary, components, well-known in the art such as fan, backup power equipment, and heat disspators can be included. In other embodiments, the computing components can be housed in a separate unit 110, such as a computer, laptop, or PDA.

The control tower 101 can serve as a conduit between a user of the system 100 and a trainer. Suitable users of the system 100 are preferably human patients requiring neuromuscular rehabilitation, such rehabilitation being required following a stroke, traumatic injury incurred during an accident or war, or long term disability such as palsy, for example cerebral palsy or elderly persons with motor function disability or weakness. A trainer utilizing the system on a users behalf can include human and non-human entities. Non-human entities include computer programs, possessing algorithms capable of training and interacting with a user. Human entities include doctors, nurses, health care professionals, and physical therapists as examples. The trainer can include one or more of a human and non-human entity, for example the human entity may program the non-human entity to perform a specific training program to be applied to the user. The trainer(s) can communicate with the control tower 101 via direct means, such as a control board attached directly to the control tower 101, or by indirect means such as by wireless communication with an off sight computer. Indirect means can include a PDA, computer, laptop, etc.

Regarding dimensions, design, and size, the control tower 101 in FIG. 1 is an embodiment suitable for the system 100, however other control towers may be used herein provided they are sufficient for providing support to the module 111. Preferably, the control tower is sized such that is allowed interaction with the user, while the user is in a variety of positions, including sitting, standing, laying down, or squatting. Further the size, such as the height, of the control unit can be adjusted to suit a user as he/she may take a variety of different positions during training. The control unit 101 preferably also contains on-board transportation means such as wheels, allowing it to be moved to a variety of different locations. To this, the control tower 101 can be made of a variety of different materials, including plastic, or lightweight metal. The use of lighter materials may be preferred in order to allow easier movability.

The rotational motor tower 103 serves as a conduit between the module 111 and the control tower 101. The rotational motor tower 101 also serves to allow training of different joints and limbs of the user. As will be discussed later, the rotational motor tower 103 is a multi-component unit capable of multi-plane movement when interacting with the user.

As shown in the embodiment of FIG. 1, the rotational motor tower 103 is positioned centered between two posts on the control tower 101, however for other embodiments, the rotational motor tower 103 can be positioned in other ways while not deviating from the concept of the system 100, such concept being the ability of the rotational motor tower 103 to rotate from a vertical to a horizontal direction, and vice versa. Other ways of positioning can include using one post instead of two.

The rotational motor tower 103 can be electronically connected to the control tower 101, such as through wires. In one embodiment, the rotational motor tower 103 is set apart from the control tower 101, i.e., not physically connected thereto. In another embodiment, the rotational motor tower 103 is physically connected to the control tower 101.

A multi-orientation module 111 is attached to the rotational motor tower 103. The module 111 is suitable for interacting with the user by allowing the user to position a limb thereon for treatment. The module 111 can operate when the rotational motor tower 103 is vertical or horizontal, or somewhere in-between.

As will be discussed later, the module 111 is capable of training a multiple different joints without requiring multiple modules.

A user positioning unit 107 is provided with the system 100. The user positioning unit 107 can be, for example a chair, a table, vertical supporter, and the like. In one embodiment, the user positioning unit 107 is a chair. The user positioning unit 107 has as a goal providing support to the body of the user while a limb is being trained. The user positioning unit 107 should solely secure the user in order to gain accurate measurements during training. Safe securing can occur by utilizing restraining means such as belts or chains. The user positioning unit 107 may be height and position adjustable, for example by allowing a unit which is a chair to recline to a flat table, or adjusting the height of the chair relative to the ground to accommodate table users. Adjusting the height and position of the chair can be performed manually, or by automatic means, for example having a chair automatically adjust itself in response to information about a specific user being entered into a computer system, such computer system being connected to the chair.

The user positioning unit 107 can be placed on a track 109. The track 109 allows the user positioning unit 107 to be moved horizontally to accommodate particular users. The track 109 can also keep the user positioning unit 107 at a standard distance from the control unit 101. The track 109 can be attached to the chassis of the control tower 101 or be "stand alone".

A feedback monitor 105 is included in the system 100. The feedback monitor 105 is used for visually instructing the user during a training session, as well as providing information on the results of the user's training. The monitor 105 can be, for example, a computer monitor. The monitor 105 can also have speakers stored thereon for providing available instruction or feedback to the user. The monitor 105 can be physically attached to the control unit 101, accepting electrical communication from the unit 101. However, the monitor 105 may be a distance from the unit 101, i.e., not physically attached. In such an embodiment, communication may be by wireless means. In one embodiment, the user interacts with the monitor 105 by touching the monitor, i.e. the monitor is touch screen operable.

The various components of the robotic system of the present invention will now be disclosed.

Figure 2:
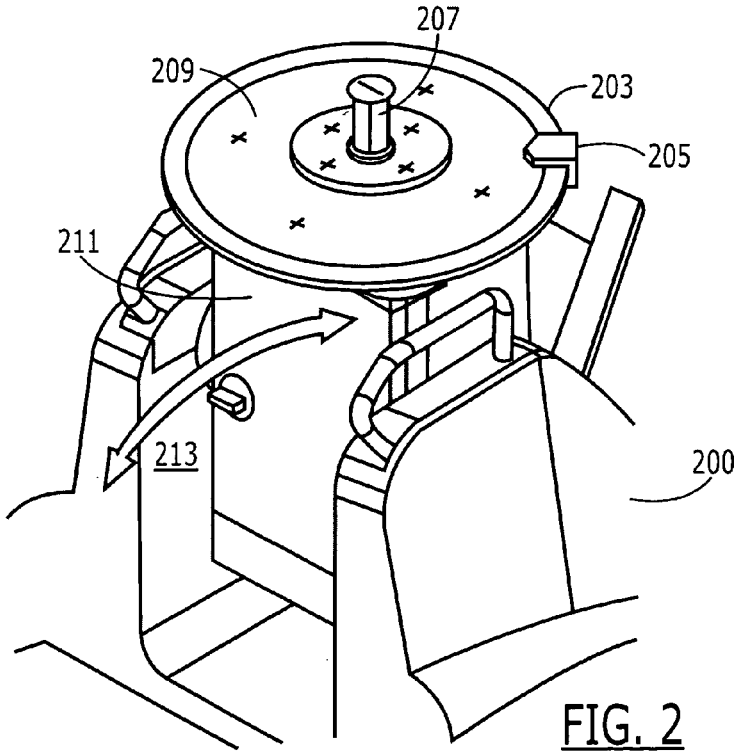
FIGS. 2 and 3 show a view of the rotational motor tower component as used in the robotic system, such component being capable of rotating from a horizontal to vertical plane and vice versa.

FIG. 2 is an embodiment of the rotational motor tower to be used in the robotic system of the preset invention. The rotational motor tower 203, as previously disclosed, is electronically connected to the control tower 200. In the embodiment of FIG. 2, the rotational motor tower 203 is physically connected to the control tower 200. The rotational motor tower 203 is capable of rotating 213 between a total vertical position (90°) to a total horizontal position (0°), and vice versa. Movement of the rotational motor tower 203 can be operated manually or electrically operaole. In manual operation of the tower 203, a trainer can physically move the tower 203 to a specific degree, for example 90°, 45°, or 0°. In electrically operating the tower 203, the tower 203 may be connected to a controller such as a computer, whereby a specific degree can be entered into the computer, and the tower 203 will rotate to the specific degree. The rotational motor tower 203 includes a housing 211, platter 209, shaft 207, and movement blocks 205.

The housing 211 can be plastic or metal. The housing should insulate and protect the inner workings of the rotational motor tower 203.

The platter 209 is used to support the training of the multi-orientation module (not shown). As will be discussed later, training occurs by allowing the user to rotate his limb joint, such as an elbow, in response to a training program. The platter 209 by physical means is able to limit the degree of rotation by the user's limb joint. The diameter of the platter 209 should be suitable for accommodating the multi-joint module.

The shaft 207, as shown in the FIG. 2 embodiment, is positioned in the center of the platter 209. However, in other embodiments, the shaft may be off-center. The shaft 207 has as its goal releasably connecting a multi-orienting module to the unit 203. As will be discussed later, the shaft 207 provides the direct torque to the multi-orienting module, allowing it to be rotated during training. The shaft 207 is preferably square or rectangular shaped to actuate the multi-orienting module.

One or more blocks 205 are positioned on the platter 209 to effectually desist the movement of the platter 209 and hence the multi-orienting module in a particular range of movement. In one embodiment, two blocks may be placed between 0° to 90° apart around the circumference of the platter 209.

Figure 3:
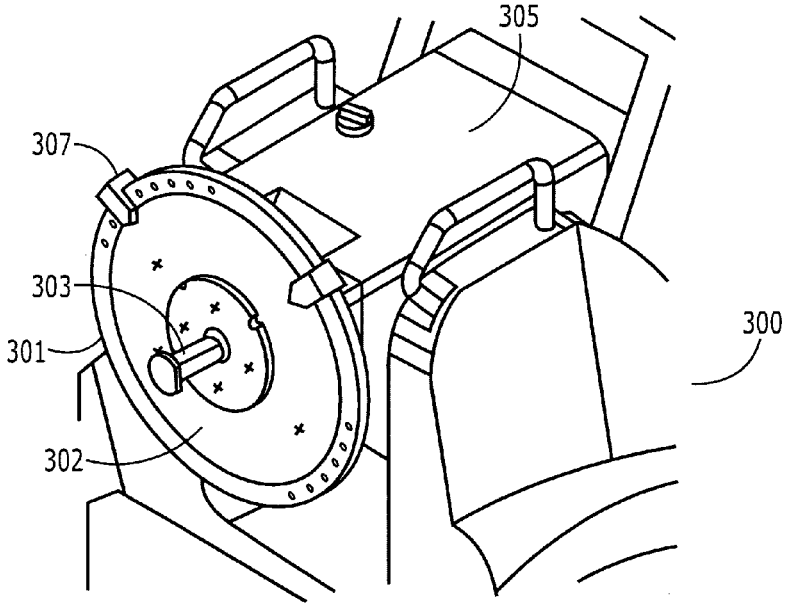

FIG. 3 is an embodiment of the rotational motor tower 301 in a total horizontal position (0°). The rotational motor tower 301, attached to the control unit 300, comprises a housing 305, a shaft 303, a platter 302, and blocks 307.

Figure 4:
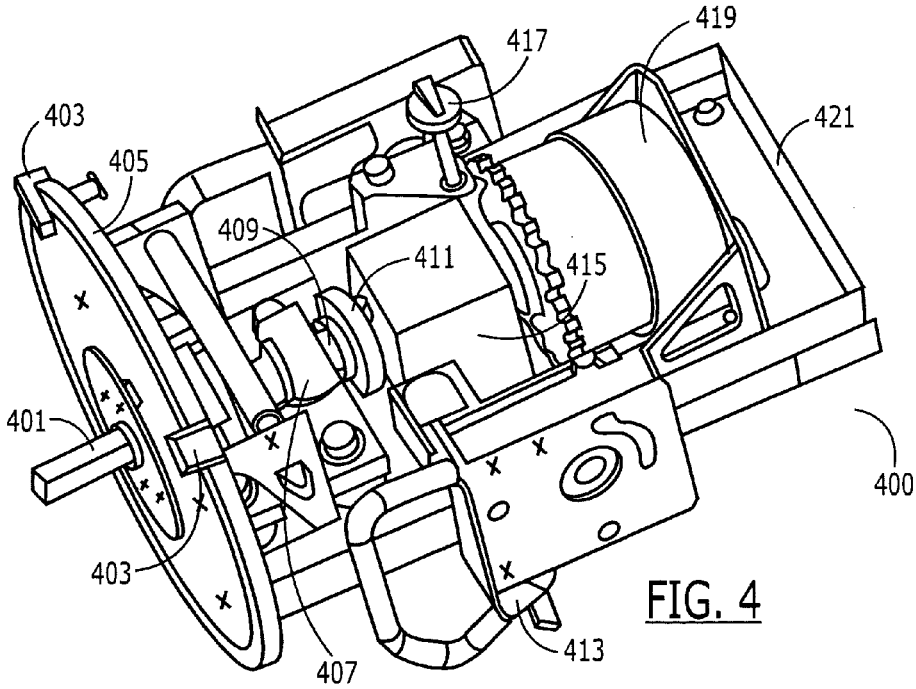
FIG. 4 is a schematic of the internal components of the rotational motor tower.

FIG. 4 is an internal schematic of an embodiment of the rotational motor tower 400 used in the robotic system. The rotational motor tower 400 components are housed on a chassis 421.

As mentioned previously, the rotational motor tower 400 includes a shaft 401. The shaft 401 is preferably square or rectangular shaped, and designed, in terms of size, to fit a female counterpart on a multi-orientation module (not shown). Blocks 403 are utilized to limit the range of movement of a multi-orientation module when attached to the unit 400. A platter 405 provides support to multi-orientation module and retains the blocks 403. A pillow block 407 is used to support all unnecessary forces except the rotational force on the motor shaft. Connectors 411 are used to mount the rotation shaft 409 on the torque sensor. Handles 413 are mounted on the control tower (not shown), on either side of the rotational motor tower 411, the handles 413 usually incorporating a gear-typed locking mechanisms to lock the tower 400 when orientation is changed. A torque sensor 415 is included, such sensor 415 can include strain gauges, slip rings, wireless telemetry, rotary transformers, conditioning electronics, and converter. A knob 417 is used to lock motor rotation, which is for torque measurement at a fixed angle through the torque sensor 415. A motor 419 is used to generate torque to the tower 400.

The robotic system of the present invention is designed to accept multi-orientation modules. Primarily, the modules are used to train a user's joints, such as wrist joint, elbow joint, knee joint, hip joint, and ankle joint on both the right and left sides. The modules can train between a total horizontal to a total vertical orientation. The modules are capable of providing a variety of muscle training, including but not limited to elbow flexion, elbow extension, ankle dorsiflexion, and ankle plantar flexion, infraspinatus and tenes minor training, subscapularis training, wrist flexion, wrist extension, knee flexion, and knee extension. The modules can be adjusted in dimensions in order to accommodate different users.

Figure 5:
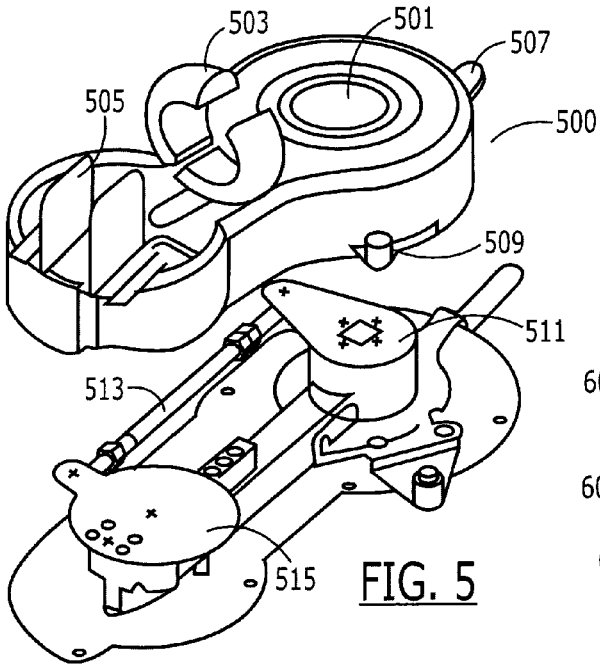
FIG. 5 shows a multi-orientational module for attachment to the control tower, such module being used for upper extremity training.
Figure 6:
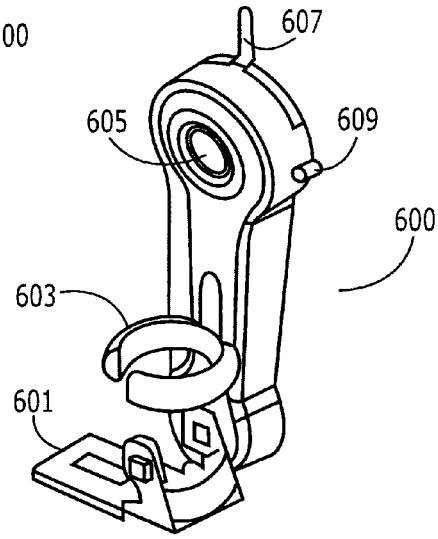
FIG. 6 shows a multi-orientation module for lower extremity training.

FIGS. 5 and 6 are embodiments of multi-orientation modules capable of being used with the system described herein.

FIG. 5 is an embodiment of an upper extremity training multi-orientation module 500. FIG. 5 shows the outward components of the module 500, as well as its inner components. The outward components can include an elbow resting plate 501, a forearm cuff 503, a handholder 505, a rotation limiter 507, and a locking mechanism 509. The module 500 can be manually adjusted. In other embodiments, the module can be electronically operable to allow adjustments via electrical signals. In such a embodiment, electrical signals can be sent to the module by a controller such as a computer.

The inner components of the module 500 include but are not limited to an upper plate 511 for facilitating training around the elbow joint of the user, a side bar 513 for allowing sufficient in-tandem behavior between the elbow joint and the wrist joint of the user, a main bar 512 and a distal plate 515 for facilitating training around the wrist joint of the user.

FIG. 6 is an embodiment of a lower extremity training multi-orientation module 600. Such a module 600 allows training around the knee joint and the ankle joint of the user. This module can comprise a foot resting stand 601, a calf cuff 603, a knee resting plate 605, a rotation limiter 607, and a locking mechanism 609. As for the upper extremity module in FIG. 5, the lower extremely module 600 can be operated manually or electronically. Specifically, the range of movement can be limited by the rotational limiter 607. The locking mechanism 609 can switch the training between knee joint and ankle joint.

When in use, the system of the present invention transfers information to and from the control unit, monitors bio-electrical signals, such as electromyographic signals (EMG), mechanomyographic signals (MMG), electroencephalographic signals (EEG), electroneurographic signals (ENG), etc., to analyze, utilize, and store information on the user's training progress, and provides feedback to the user. Further to monitoring bio-electrical signals, the bio-electrical signals are also used to adjust the training of the user's limb, such as by increasing or decreasing torque applied to the multi-orientation module.

Figure 7:
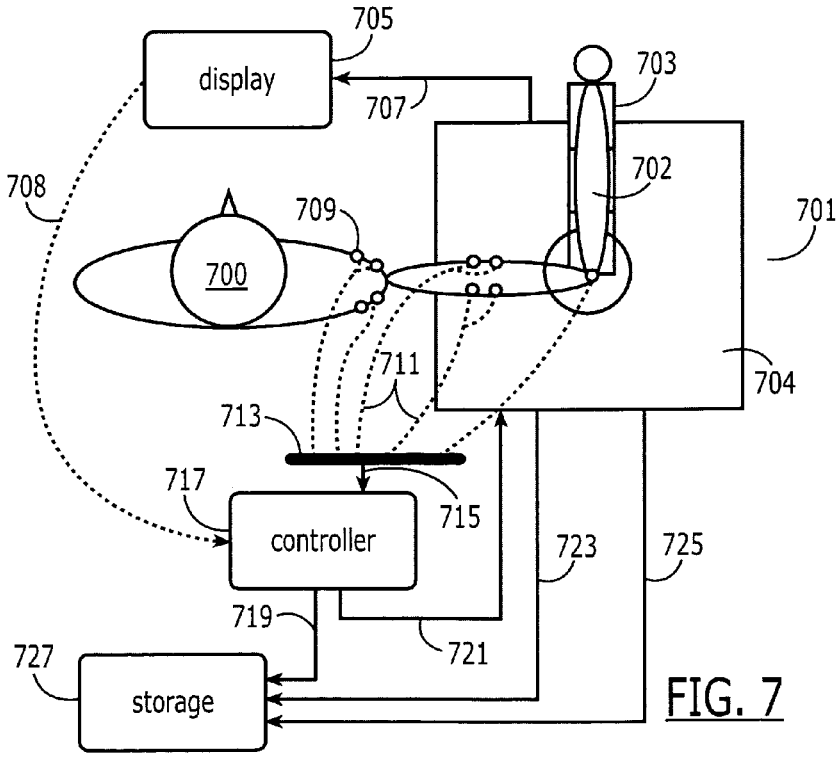
FIG. 7 shows the transfer of information among various components of the system.

FIG. 7 is an information transfer schematic within a robotic training system 701 of the present invention. Through the various components of the system 701, signals, including but not limited to bio-electrical signals, digital signals, and electrical signals are delivered to analyze, and adjust the training of the user's 700 limb. In FIG. 7, the limb to be trained as an example, is the upper extremity of the user 702.

In FIG. 7, the upper extremity 702 is positioned on a multi-orientation module 703 attached to a control tower 704. A display 705, such as a computer monitor, is positioned in front of the user 700. When in use, the control tower 704 can instruct the user during training by communicating instructions 707 on the display 705. Feedback signals can also be sent by the user 700 to a training program, operated by a controller 717.

To record the performance of the user 700 during training, electrodes 709 are attached to the user 700 in specific locations. In one embodiment, electrodes 709 are attached in locations thought to generate EMG signals that will be affected during testing, for example the muscle belly of biceps brachii, triceps brachii (lateral head), anterior deltoid, and posterior deltoid. The electrodes 709 can be attached to the skin surface. While not all locations for attachment of electrodes is given herein, it is well within the knowledge of one with ordinary skill to know which areas to attach electrodes to when measuring EMG.

The electrodes 709 are used for measuring and transmitting EMG signals 711 from the user 700. Signals 711 may be transmitted in a wired fashion, or witlessly, depending on whether the electrodes possess wireless components.

EMG signals 711 from the electrodes 709 are collected by a circuit processor 713. The processor 713 can have the capability to convert the signals 711, for example from analog to digital, amplify the signals 711, filter the signals 711, compare the signals 711, such as comparing a true measured signal against a desired reference signal, or smooth out the signals 711, such as by removing noise. The processor 713 can have multiple capabilities, for example amplifying the signals 711 and filtering the signals 711.

A resultant signal 715 is generated by the processor 713 and forwarded to a controller 717. In a preferred embodiment, the resultant signal 715 is digital. Through the controller 715, the resultant signal 715 can be used to adjust the training program. Specifically, the controller 717 can adjust the torque assistance delivered by the module 703 by forwarding a signal 721 to the control tower 704. The torque assistance can be increased or decreased depending on the users' results during training. The usage of the resultant signal 715 by the controller 717 allows for real time training adjustment as compared with adjusting after training has been completed.

The resultant signal 715 is also preferably passed through the controller 719 and stored on a storage device 727.

As previously stated, the controller 717 is used for accepting resultant signal 715. The controller 717 is also used for delivering an initial training program to the control unit 704, which can be visualized on the display 705 and adhered to by the user 717. The controller 717 may include microprocessors, algorithms, graphic cards, user interface devices, such as keyboards, mouse, wireless technology components such as antennas, and the like. In one embodiment, the controller 717 is positioned within the control tower 704. In another embodiment, the controller 717 is at a remote location from the control tower 704, whereby communication can be had by, for example, satellite communication, WIFI, or internet lines.

The control tower 704 can also deliver signals 723/725 to a storage device 727 for further analysis. Signals, such as a measured torque signal 723 and a measured joint angle signal 725 to be sent can relate to those gathered during training, specific to the control unit 704 such as degree of the rotational motor tower (not shown) 704, range movement limitation, speed of movement of the module 703, torque sensor datex, etc.

The storage device 727 can either be permanent, such as ROM, or temporary such as RAM. Like the controller 717, the storage device 727 can be on-site or at a remote location from the control unit 704, communicating therewith by wireless means or internet technology.

As stated throughout, via the rotational motor tower and multi-orientation module, the system is able to train different joints of a user's limb in different planes with one module. The system trains by providing a target goal for the user to strive for, and providing assistance to the user to obtain the target goal. In striving for the target goal, the user is required to move their limb. For example, the target goal may be an object, real or imaginary, the user must aim for. In one embodiment, the target goal is a visual object on a computer screen, such object moving based on an algorithm. The user is required to track the object as it moves. Tracking occurs by moving the module-attached limb in the plane that the module is oriented in (x, y, or z).

During tracking, active-assisted torques are generated by the motor systems during extension of the users limb. A supportive torque is controlled by electromyographic signals delivered from the user to a controller of the system.

The active-assisted torque during the extension movement is defined as:

$$T_a = G \cdot T_{IMVE} \cdot M_t \tag{1}$$

where G is a constant gain used to adjust the magnitude of the assistive torque and $T_{IMVE}$ is the maximum value of the extension torque at the elbow angle of 90°. $M_t$ in equation 1 is defined a $$M_t = \frac{EMG_{MUS} - EMG_{mrest}}{EMG_{tIMVE} - EMG_{mrest}} \tag{2}$$

where $EMG_{MUS}$ was muscle electromyographic activity after the processes of full-wave rectification and moving average, $EMG_{mrest}$ was the averaged $EMG_{MUS}$ during the resting state, and $EMG_{tIMVE}$ was the maximum value of $EMG_{MUS}$ during IMVE. The reasons for applying supportive torques in extension only include that same users usually have more difficulty in carrying out extension than flexion, and their flexors are commonly more spastic than extensors. It has been found that the elbow tracking and reaching performances of poststroke subjects can be immediately improved when employing this type of active-assisted robot devices.

Resistive torques can also be applied to training with values of a percentage of the torques during the maximum voluntary contractions (extension and flexion), that is $$T_r = a \cdot T_{MVC}$$

where $T_r$ was the resistive torque, a was the percentage, and $T_{MVC}$ that includes 2 parts, the maximum $T_{IMVF}$ (applied in the flexion phase only) and $T_{IMVE}$ (applied in the extension phase only). The net torque provided by the robot during the training is $$T_n = T_a - T_r$$

where $T_a$ is the supportive torque and $T_r$ was the resistive torque. The purposes of applying the resistive torques proportional to the IMVF and IMVE during the training are (1) to improve the muscle force generation of a paretic limb, and (2) to keep the effective muscular effort at a level associated with a possible increase in muscle force during the training. Although $T_a$ and $T_r$ would tend to cancel, the 2 torques are directly related to the own effort of the users during the training. Therefore, the net torque provided by the robot is interactive to the motor ability of subjects.

Figure 8:
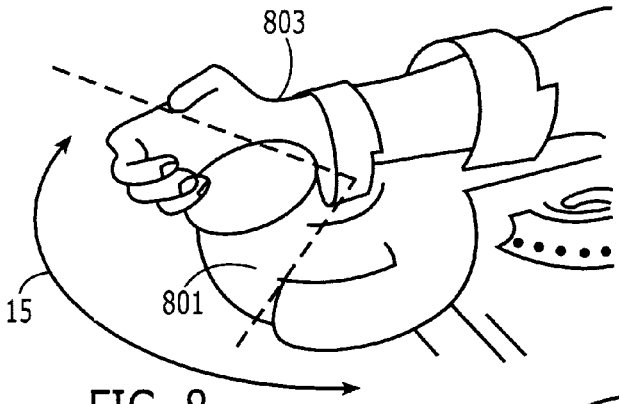
FIG. 8 shows the plane of movement for the wrist when the limb is being trained.

FIG. 8 shows the plane of movement of the user's wrist 803 when the multi-orientation module 801 is face-up. In this orientation, movement 805 is focused on the wrist 803, with the movement 805 being along the y-plane. Movement 805 will be range-limited by the blocks positioned on the rotational motor tower (not shown).

Figure 9:
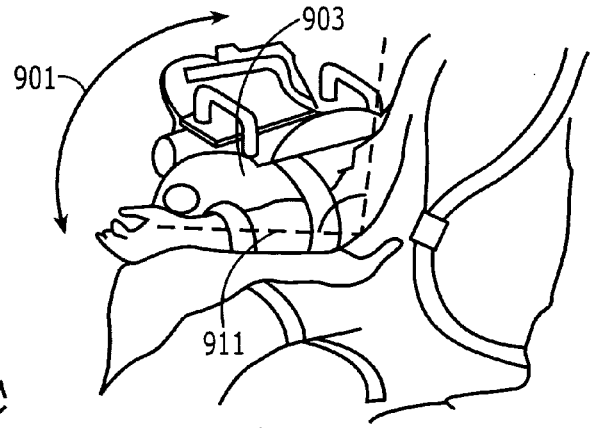
FIG. 9 shows the plane of movement for the arm when the module is vertically positioned.

FIG. 9 shows the plane of movement of the user's forearm 911 when the multi-orientation module 903 is side-ways. In this orientation, movement 901 is focused on the elbow, with movement along the x-plane.

FIG. 10 shows the plane of movement of the user's elbow 1007 when the multi-orientation module 1001 is face-up. Movement 1005 in this orientation allows rotation of the elbow along the y-plane.

FIG. 11 shows an embodiment of using the multi-orientation module 1103 to train lower extremities 1101, such as the knee. The movement 1105 in this orientation is in the x-plane.

EXAMPLE 7 hemiplegic subjects after stroke were recruited. All of the subjects were in the chronic stage (at least 1 year postonset of stroke; 6 men, 1 woman; age, 51.1±9.7 y). All subjects received a robot-assisted elbow training program using the present invention consisting of 20 sessions, with at least 3 sessions a week and at most 5 sessions a week, and finished in 7 consecutive weeks. Each training session was completed in 1.5 hours. Before and after the training, we adopted 2 clinical scales to evaluate the voluntary motor function of the paretic upper limb (the elbow and shoulder) of the subjects, including the Fugl-Meyer Assessment (FMA; for elbow and shoulder; maximum score, 42) and the Motor Status Scale (MSS; shoulder/elbow; maximum score, 40). Spasticity of the paretic elbow of each subject before and after the training was assessed by the Modified Ashworth Scale (MAS) score. The clinical assessments of this study were conducted by a blind therapist.

During each training session, each subject was comfortably seated, and the affected upper limb was placed horizontally on an electromyography-driven motor system with the elbow joint positioned at the origin. The forearm of the affected side was placed on a manipulandum, which could rotate with the motor; and the elbow angle signals were measured by the motor via readings of the positions of the manipulandum. A belt was used to fasten the shoulder joint in order to keep the joint position still during elbow extension and flexion. Electromyography electrode pairs with a center separation of 2 cm were attached to the skin surface of the muscle belly of biceps brachii (BIC), triceps brachii (TRI), anterior deltoid (AD), and posterior deltoid (PD). The positions of the electromyography electrode pairs were not moved once placed. The electromyographic signals were preamplified, band-pass filtered (from 10 to 500 Hz) and recorded through an analog-to-digital card, together with the angle signals, with a sampling frequency of 1000 Hz.

The electromyographic signals for the muscles of interest during the resting state were first recorded before any voluntary motion taken by a subject in each session, which served as the electromyographic baselines of the individual muscles for the session. The isometric maximum voluntary flexion (IMVF; duration, 5 s) and extension (IMVE; duration, 5 s) of the elbow at a 90° elbow angle were then measured at a repetition of 3 times, respectively, with a 5-minute rest break in between each contraction to avoid muscle fatigue. During the training, each subject was required to carry out voluntary elbow flexion and extension in the elbow range from 0° to 90° (0° representing full extension) by tracking a target cursor moving at an angular velocity of 10° per second on the screen for both flexion and extension.

10° per second was chosen as a reasonable speed for subjects after stroke to follow, in order to prevent too difficult or too easy a pace for the subjects to achieve. Each subject was allowed to practice tracking for 10 minutes before the start of the training for them to familiarize themselves with the course. In each training session, there were 18 tracking trials, and each trial had 5 cycles of elbow extension and flexion. In all trials, active-assisted torques were given in extension associated with the gain, G in equation 1, equal to 0%, 50%, and 100% alternatively applied to the tracking trials in a session. Resistive torques were applied to each trial.

Figure 12:
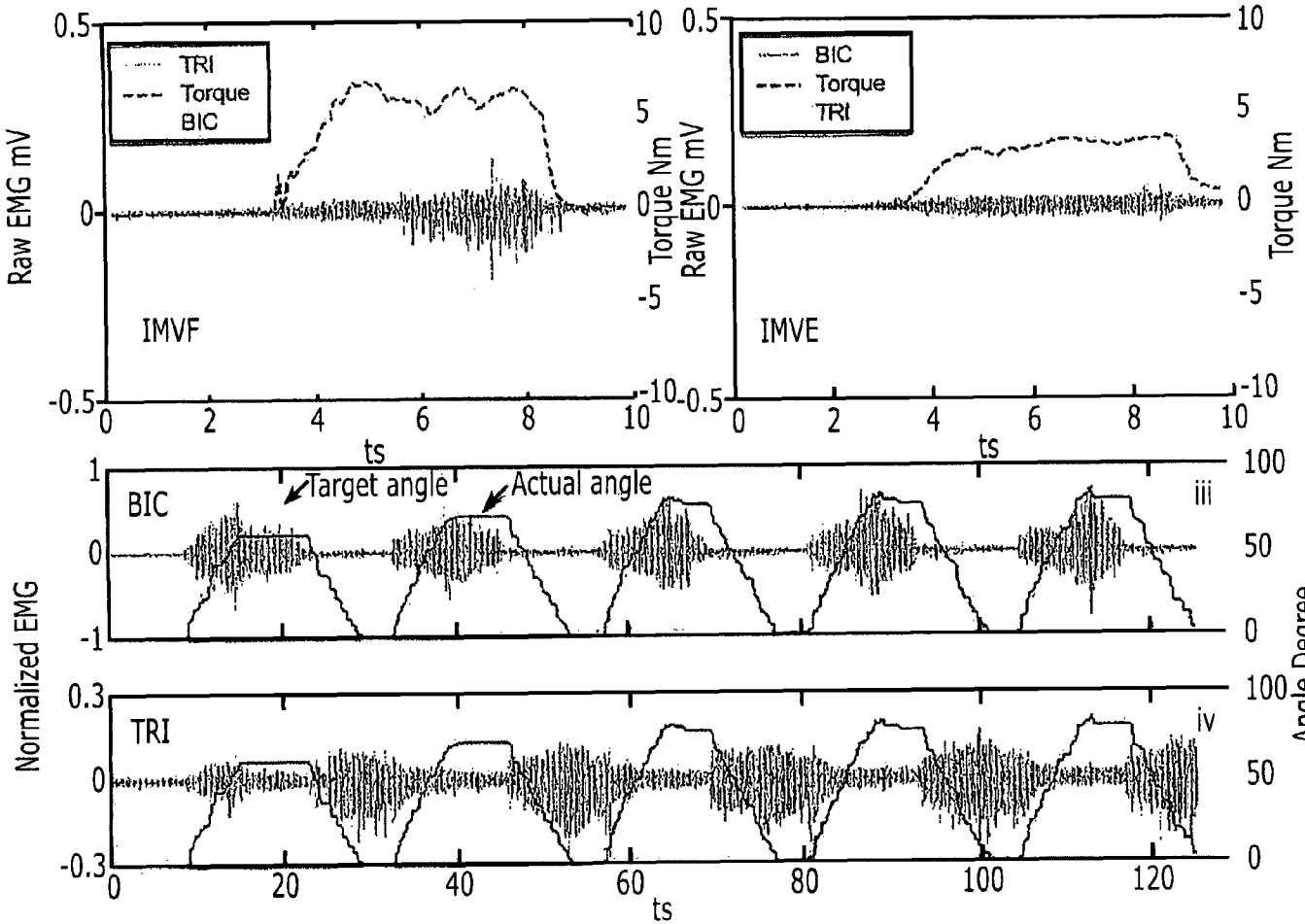

Electromyographic activity from the muscles of interest and angle signals during the training were recorded and stored in a computer during the even sessions of the training for processing. The elbow angle signals were low-pass filtered with a cutoff frequency of 20 Hz. The torque signals during the IMVF and IMVE were also low-pass filtered with a cutoff frequency of 10 Hz. A forth-order, zero-phase forward and reverse Butterworth digital filter was adopted for the filtering processes. FIG. 12 shows the representative signals recorded from a subject during the training.

Figure 13:
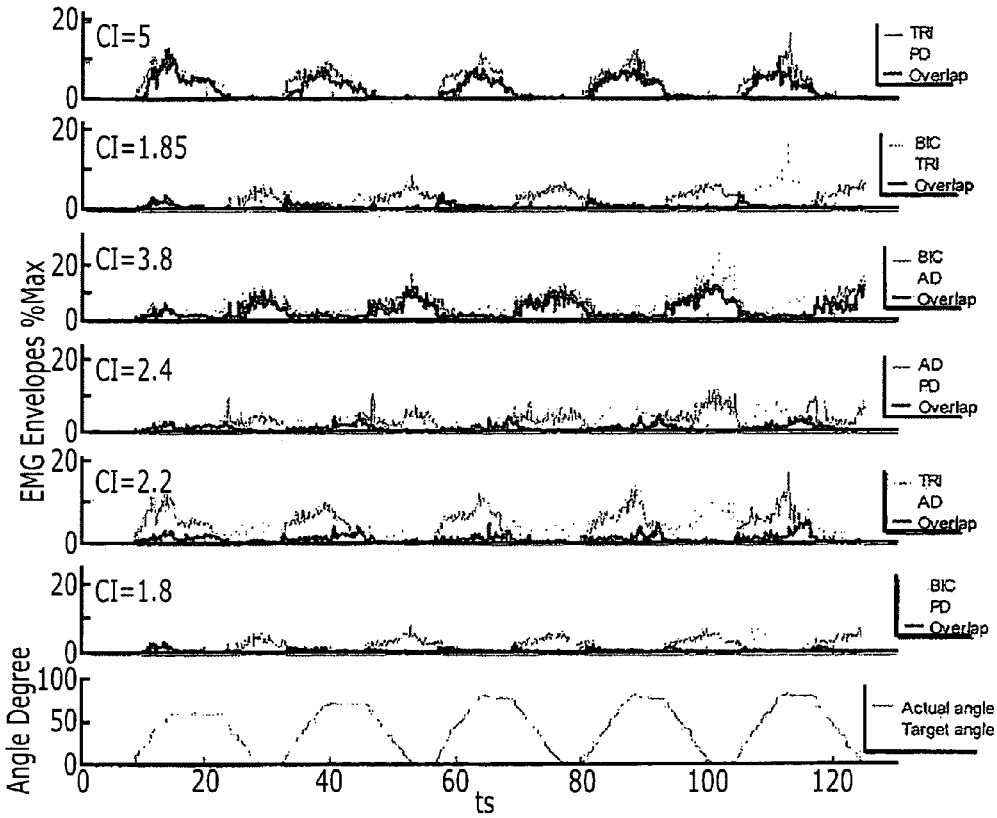

The coactivations among muscle pairs during the training were studied by the cocontraction index (CI), that is, $$CI = \frac{1}{T}\int_T A_{ij}(t)dt \tag{3}$$

where $A_{ij}(t)$ was the overlapping activity of electromyographic linear envelopes for muscles i and j, and T was the length of the signal. The value of a cocontraction index for a muscle pair varied from 0 (no overlapping at all in the signal trial) to 1 (total overlapping of the 2 muscles with both electromyographic levels kept at 1 during the trial). The representative segments of electromyographic envelopes from the muscle pairs in a tracking trial are shown in FIG. 13. The electromyographic activation level of a muscle in a tracking trial was also calculated by averaging the electromyographic envelope of the trial. The cocontraction indexes for different muscle pairs, the electromyographic activation levels of each muscle, and the root mean square error (RMSE) between the target and the actual elbow angle were calculated for each trial of all even sessions. The averaged values of the cocontraction indexes and RMSEs of all trials in a session for each subject were used as the experimental readings for statistical analyses.

Figure 14:
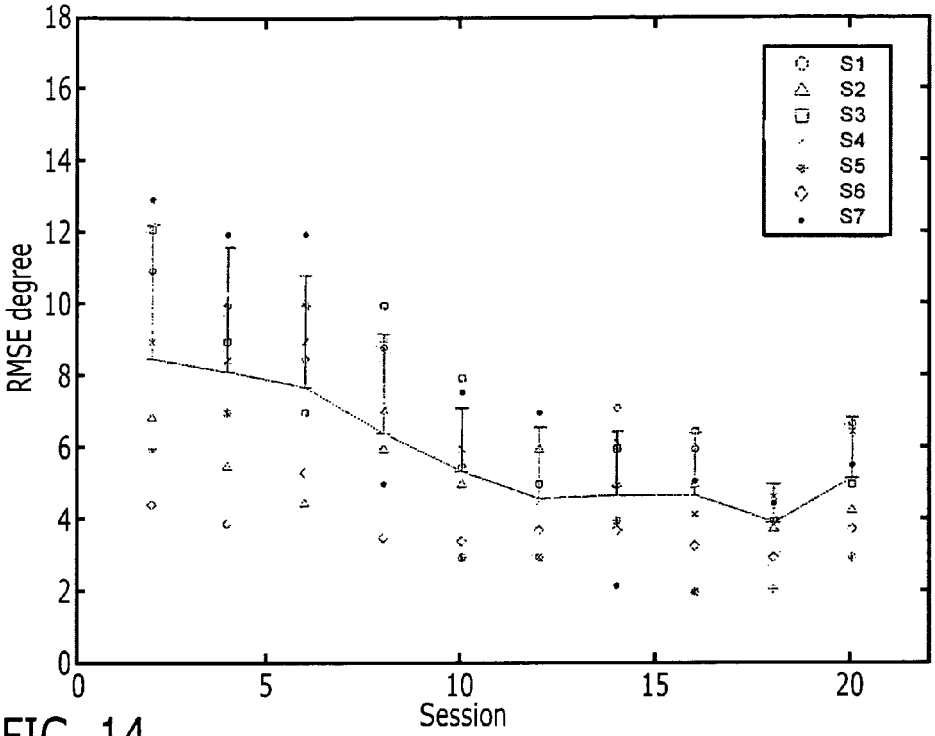

FIG. 14 shows the variation of the overall RMSE of the elbow angle during the tracking training. The overall RMSE varied significantly across the sessions with a decreasing tendency. Decreasing tendencies in mean RMSE value were also observed in all individual subjects by comparing the mean RMSE values of the 2nd and 20th sessions and the decreases varied from 15.6% (subject 6) to 59% (subject 3). For subjects 1, 2, 3, 4, and 7, the maximum RMSEs were observed at the 2nd session; while for subjects 5 and 6, the maximum RMSEs appeared at the 6th session.

Figure 15:
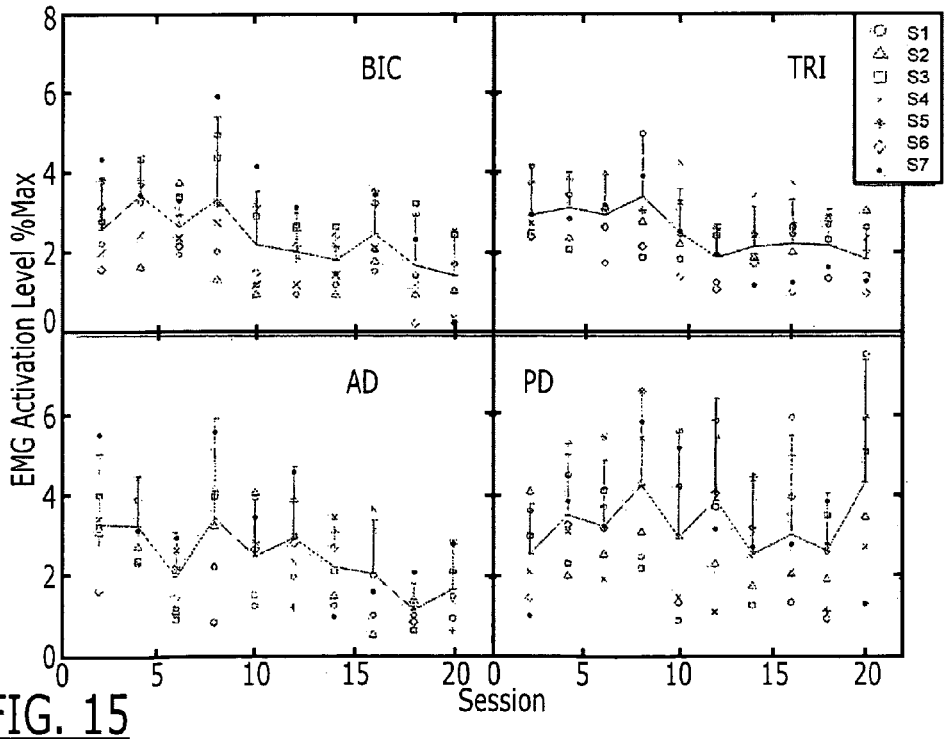

FIG. 15 shows the electromyographic activation levels of each muscle during the training. The overall electromyographic activation level of the 4 muscles varied significantly across the sessions during the training. A significant decreasing tendency in the overall electromyographic activation level for the biceps brachii, triceps brachii, and anterior deltoid were found by comparing the maximum value (observed at the 4th session for the biceps brachii, at the 8th session for the triceps brachii and anterior deltoid) and the value at the last session. Decreases in the mean electromyographic activation level of the biceps brachii, triceps brachii, and anterior deltoid for the individual subjects were also found, varying from 3.3% (subject 2, triceps brachii) to 84.7% (subject 7, biceps brachii), with the maximum values appearing on or before the 10th session.

Figure 16:
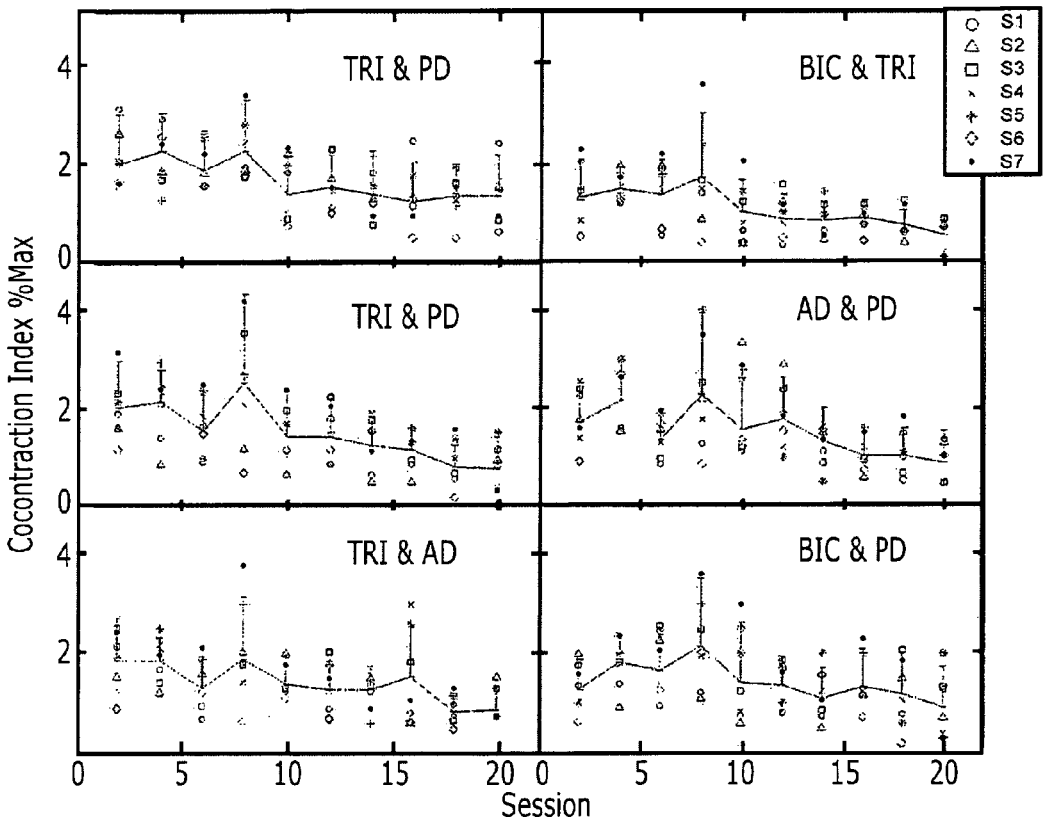

FIG. 16 shows the muscle cocontraction patterns during the training, represented by the cocontraction index of each muscle pair. The variations in the overall cocontraction index of all muscle pairs were significant, and the overall cocontraction index of all muscle pairs reached their maximum at the 8th session. The overall cocontraction indexes of the muscle pairs biceps brachii and anterior deltoid, anterior deltoid and posterior deltoid, and triceps brachii and anterior deltoid reached a local minimum at the 6th session before the appearance the maximum mean values at the 8th session. For all muscle pairs, there was a significant decrease in the cocontraction index value from the 8th session to the 10th session. After the 8th session (from the 10th to 20th sessions), the overall cocontraction index values of the biceps brachii and triceps brachii, biceps brachii and anterior deltoid, anterior deltoid and posterior deltoid, and triceps brachii and anterior deltoid showed a significant decreasing tendency until the end of the training. By comparing the maximum cocontraction index value and the cocontraction index at the last session, decreases in the cocontraction indexes of the muscle pairs for the individual subjects were found to vary from 7.6% (biceps brachii and posterior deltoid for subject 1) to 82.5% (biceps brachii and triceps brachii for subject 7).

In this study, significant motor improvements assessed by MAS, FMA, and MSS were observed after the 20-session training on elbow tracking task actively assisted by the robot. The electromyographic activation levels of the major agonist and antagonist muscle pair of the elbow joint, biceps brachii and triceps brachii, significantly decreased in the first half of the training course, which was associated with an improvement in tracking skill and a decrease in spasticity. The electromyographic level of the anterior deltoid also decreased during the training, suggesting a better isolation of elbow movements from the shoulder in the paretic limb. The results obtained provided further understanding of the recovery process, especially muscle coordination, during interactive robot-assisted training, which would be useful for the design of robot-assisted training programs.

Having described embodiments of the present system with reference to the accompanying drawings, it is to be understood that the present system is not limited to the precise embodiments, and that various changes and modifications may be effected therein by one having ordinary skill in the art without departing from the scope or spirit as defined in the appended claims.

In interpreting the appended claims, it should be understood that:

a) the word "comprising" does not exclude the presence of other elements or acts than those listed in the given claim;

b) the word "a" or "an" preceding an element does not exclude the presence of a plurality of such elements;

c) any reference signs in the claims do not limit their scope;

d) any of the disclosed devices or portions thereof may be combined together or separated into further portions unless specifically stated otherwise; and e) no specific sequence of acts or steps is intended to be required unless specifically indicated.

The invention claimed is:

1. A robotic system for multiple joint training using one training module, comprising a control tower having at least one locking mechanism;

a measuring unit configured to measure bio-electrical signals of a user;

a controller configured to determine an assistive torque ($T_a$) and a resistive torque ($T_r$) based on the measured bio-electrical signals, and calculate a net torque ($T_n$) based on the difference of $T_a$ and $T_r$ ($T_n=T_a-T_r$), and $T_a$ and $T_r$ are calculated by the following equations:

$$T_a=G\cdot T_{IMVE}\cdot M_t,$$

$$T_r=a\cdot T_{MVC}, \text{ and}$$

$$M_t=\frac{EMG_{MUS}-EMG_{mrest}}{EMG_{tIMVE}-EMG_{mrest}};$$

wherein G is a constant gain used to adjust a magnitude of the assistive torque, $T_{IMVE}$ is a maximum torque applied in an extension phase, $T_{MVC}$ includes a maximum torque applied in a flexion phase ($T_{IMVF}$) and the $T_{IMVE}$;

a rotational motor tower, said motor tower having a motor configured to deliver the net torque ($T_n$); and a multi-orientational module positioned on said rotational motor tower for contacting a user's limb, wherein said locking mechanism is positioned on a handle for locking, said rotational motor tower in a position between total horizontal to total vertical, and said multi-orientational module is selected from the group consisting of a lower extremity module and an upper extremity module.

2. The robotic system in claim 1, wherein said control tower comprises two locking mechanisms, with both mechanisms are positioned on two separate handles.

3. The robotic system in claim 1, further comprising a monitor;

a user positional unit;

a storage device; and a knob for locking motor rotation.

4. The robotic system in claim 3, wherein said controller is positioned on said control tower, said storage device is positioned within said control tower, said monitor is physically attached to said control tower, and said rotational motor tower is attached to said control tower.

5. The robotic system in claim 1, wherein said rotational motor tower comprises, a shaft for connecting with said multi-orientational module;

at least one pillow block;

a platter having position-adjustable blocks attached thereto;

a torque sensor;

a chassis; and a housing.

6. The robotic system in claim 1, further comprising electronic components for electronic operability.

7. The robotic system in claim 3, wherein said monitor is a touch screen monitor.

8. The robotic system in claim 3, wherein said user positional unit is a chair.

9. The robotic system in claim 1, wherein said controller comprises joint training algorithms.

10. The robotic system in claim 1, further comprising a circuit processor for processing signals.

11. The robotic system in claim 1, wherein said multi-orientational module is comprised of a distal plate, and an upper plate, connected by a main bar and side bar.

12. A method of training multiple joints in a limb using the robotic system in claim 1, comprising the steps of:

positioning a user in a user positional unit;

inserting a limb into a multi-orientational module;

rotating a first joint of said limb while simultaneously measuring bio-electrical signals;

rotating a second joint of said limb while simultaneously measuring bio-electrical signals;

determining an assistive torque ($T_a$) and a resistive torque ($T_r$) based on the measured bio-electrical signals;

calculating a net torque ($T_n$) based on the difference of $T_a$ and $T_r$ ($T_n = T_a - T_r$), wherein $$T_a = G \cdot T_{IMVE} \cdot M_t,$$

$$T_r = a \cdot T_{MVC}, \text{ and}$$

$$M_t = \frac{EMG_{MUS} - EMG_{mrest}}{EMG_{tIMVE} - EMG_{mrest}},$$

G is a constant gain used to adjust a magnitude of the assistive torque, $T_{IMVE}$ is a maximum torque applied in an extension phase, $T_{MVC}$ includes a maximum torque applied in a flexion phase ($T_{IMVF}$) and the $T_{IMVE}$; and delivering the net torque from the motor to said first or second rotating joint in response to said measured bio-electrical signals.

13. The method of training multiple joints in claim 12, further comprising the step of rotating said multi-orientational module via the rotational motor tower along a horizontal to vertical plane.

14. The method of training multiple joints in claim 12, wherein said first joint can be selected from the group consisting of elbow joint, wrist joint, and shoulder joint.

15. The method of training multiple joints in claim 14, wherein said second joint is different from said first joint and is selected from the group consisting of elbow joint, wrist joint, and shoulder joint.

16. The method of training multiple joints in claim 12, wherein said first joint can be selected from the group consisting of hip joint, knee joint, and ankle joint.

17. The method of training multiple joints in claim 16, wherein said second joint is different from said first joint and is selected from the group consisting of hip joint, knee joint, and ankle joint.

18. The method of training multiple joints in claim 12, further comprising the steps:

processing said steps of bio-electrical signals after simultaneous measurement with first joint rotation; and processing said bio-electrical signals after simultaneous measurement with second joint rotation.

19. The method of training multiple joints in claim 13, wherein torque from a motor can be selected from the group consisting of active-assisted torque, resistance torque, and active-assisted/resistance torque.

20. The method of training multiple joints in claim 13, wherein bio-electrical signals is selected from the group consisting of electromyographic signals, mechanomyographic signals, electroencephalographic signals, and electroneurographic signals.

* * * * *